United States Patent [19]

Kiefer

[11] 4,335,873

[45] Jun. 22, 1982

[54] TOGGLE BOLT CLAMP

[75] Inventor: Henry Kiefer, Troy, Mich.

[73] Assignee: C. J. Edwards Company, Royal Oak, Mich.

[21] Appl. No.: 151,845

[22] Filed: May 21, 1980

[51] Int. Cl.[3] ..... B25B 1/14

[52] U.S. Cl. ..... 269/228; 269/274; 269/275

[58] Field of Search ..... 269/275, 228, 281, 283, 269/263, 274, 275, 249; 248/188.9; 403/362, 361; 29/453, 450, 447

[56] References Cited

U.S. PATENT DOCUMENTS

| | | | |
|---|---|---|---|
| 789,906 | 5/1905 | Gordon | 269/228 X |
| 2,602,641 | 7/1952 | Wade | 403/361 |
| 2,744,283 | 5/1956 | Reineman | 248/188.9 |
| 2,865,133 | 12/1958 | Hoven et al. | 248/188.9 |
| 2,974,984 | 3/1961 | Koch | 29/453 |
| 2,985,469 | 5/1961 | Bowman | 29/453 |
| 3,213,524 | 10/1965 | Prather et al. | 29/453 |
| 3,284,258 | 11/1966 | Patti et al. | 29/447 |
| 3,322,423 | 5/1967 | Popow et al. | 269/275 X |
| 3,872,760 | 3/1975 | Desnoyers | 269/228 |

FOREIGN PATENT DOCUMENTS

| | | | |
|---|---|---|---|
| 1109742 | 11/1953 | France | 29/453 |
| 34609 | 5/1911 | Sweden | 248/188.9 |

*Primary Examiner*—Robert C. Watson

*Attorney, Agent, or Firm*—Jay C. Taylor; Neal A. Waldrop

[57] ABSTRACT

A toggle clamp has a bolt carried by a swinging clamping arm for generally axially and limited arcuate movement in a clamping operation against a workpiece. The clamping end of the bolt is removably secured within a socket in a polyurethane work engaging bumper and seated against the socket base. By virtue of the physical characteristics of the polyurethane and interference fit between the bolt and the socket wall throughout an appreciable axial extent, the assembled bolt and bumper are capable of withstanding the axial and radial forces of repeated clamping operations and outwearing comparable assemblies available heretofore without recourse to a chemical bond between the bolt and bumper or an enlarged force distributing bolt head as has been required heretofore.

10 Claims, 5 Drawing Figures

TOGGLE BOLT CLAMP

The present invention relates to a clamp and in particular to a work clamping plunger commonly known as a toggle bolt adapted to be adjustably secured to the swinging end of a toggle actuated clamping arm and having an elastomeric bumper or work engaging cushion at one end.

BACKGROUND AND OBJECTS OF THE INVENTION

A typical work clamping assembly comprises a swinging clamping arm, actuated for example by toggle means, for moving a screw threaded plunger or toggle bolt generally axially in a clamping action against a workpiece. The screw threads of the bolt or plunger are cooperable with threaded locking means screwed thereon for selectively adjusting the effective axial distance along the plunger between the operating arm and a clamped workpiece.

The work engaging end of the plunger comprises an elastomeric bumper or cushion, commonly a rubber-like material such as neoprene, that engages and protects the clamped workpiece. The plunger preferably comprises a threaded steel rod or bolt protected by a metallic coating such as a copper or zinc dichromate plating and having an enlarged hexagonal head. The neoprene bumper is usually formed by compression molding on the bolt head which is encased within the bumper as an insert during the molding operation, thereby to interlock the bumper and bolt and also to provide a comparatively large area for distributing the clamping force against the neoprene bumper. Where the cross-sectional area of the bolt is sufficiently large and the clamping force required is sufficiently small, the enlarged bolt head may not be required, in which case the portion of the bolt embedded within the neoprene bumper may comprise a screw threaded stud. In any event an appreciable axial extent of the bolt must be chemically bonded to the bumper in order to withstand side loading or radial forces exerted by the bolt on the bumper during a clamping operation.

In the latter regard, when the bolt is carried by the swinging end of a toggle actuated clamping arm, the clamping movement of the bolt and bumper against the workpiece is slightly arcuate rather than truly axial. In consequence, the subassembly of the bolt and bumper are subjected to severe distorting forces that are unique to such assemblies. The bumper must be sufficiently elastic and resiliently deformable to serve properly as a protective cushion for the workpiece, yet must be sufficiently resistant to deformation and shearing to prevent its being punctured by the bolt during repeated use, such that the workpiece would be damaged by direct contact with the steel bolt. Also the bumper must cling to the bolt with sufficient tenacity to prevent relative radial displacement of the bolt that would eventually cause shearing and destruction of the material of the bumper. For these reasons, the enlarged bolt head bonded within the bumper and an appreciable axial extent of the bolt chemically bonded to the material of the bumper have been required heretofore. Otherwise a bumper sufficiently hard and form sustaining to cling to the bolt would be too hard and inelastic to withstand disintegration by the severe clamping forces and would not provide adequate cushioning for the workpiece.

The above noted limitations on conventional neoprene toggle bolt and bumper subassemblies give rise to several objections. At the outset, when one end of the threaded bolt is located within the mold as an insert when the bumper is molded, some of the moldable material runs along the screw threads of the bolt and hardens thereat as flashing. The effective unobstructed axial length of the threaded bolt is thus decreased and its axial adjustability with respect to the clamping arm of the toggle clamp is likewise decreased.

Furthermore, when the toggle bolt and bumper are molded together as a unit, difficulty is often encountered when the protective metallic plating is applied to the bolt. Federal regulations, for example, prohibit molding of the neoprene bumper on the preferred copper plated bolt. Accordingly the bolt must be copper plated after the molding operation. The plating procedure required for optimum copper plating reacts with the neoprene material of the bumper. Either a less satisfactory copper plating that does not react with the neoprene, or a less satisfactory substitute metallic plating such as the zinc dichromate plating must be accepted.

In addition, when the elastomeric bumper is molded on the toggle bolt and is integrally bonded chemically thereto, if the resulting article is defective when taken from the mold, both the bolt and bumper must be discarded. Because it is too difficult to remove the defective bumper from the bolt, the material of the bumper along with the bolt become a costly waste.

An important object of the present invention is to provide an improved toggle bolt and elastomeric bumper of the general character described which avoid the above objections and achieve a number of important advantages over similar conventional devices.

Another object is to provide such a toggle bolt and bumper wherein the bumper is molded from a thermoplastic polyurethane independently and separately from the bolt. The bumper is formed to provide a body of the polyurethane axially spacing a work abutting surface and a bolt abutting surface. The latter comprises the base of a socket adapted to receive one end of the bolt snugly therein with an interference fit. The axially extending walls of the socket comprise a support that resiliently engage and hold the bolt in coaxial alignment with the bumper when the two are assembled.

The bolt is likewise formed separately from the bumper and is thereafter removably assembled with the bumper as described herein by being forced axially endwise into the bolt receiving socket of the bumper until the inner end of the bolt firmly abuts the socket base. By virtue of the toughness of the polyurethane material of the bumper and its far greater resistance to shearing and permanent deformation as compared to neoprene or rubberlike materials of comparable elasticity or cushioning ability, the polyurethane bumper firmly grips the bolt and adequately resists the axial clamping forces without recourse to an enlarged forcedistributing bolt head, and similarly resists lateral or radial forces that tend to move the work engaging surface of the bumper laterally with respect to the bolt axis without necessitating a chemical bond between the bumper and bolt. At the same time the resiliency of the polyurethane provides the desired cushioning properties for protecting the clamped workpiece.

The polyurethane material of the bumper enables the latter and the bolt to be feasibly formed separately from each other and removably assembled together as desired, thereby to achieve several important cost savings as described below. Also by avoiding the necessity of molding and bonding the bumper on the toggle bolt, the bolt may be conveniently plated with any desired material and by the optimum plating process. In consequence a preferred high quality copper plating is readily feasible.

The elimination of an enlarged bolt head molded within the bumper, as required heretofore in order to obtain a bumper that would provide both the protective cushioning for the workpiece and also the load bearing quality necessary to survive the severe clamping force, also enables simplification of the mold and the molding operation because the mold in accordance with the present invention is not required to accommodate the bolt inserted thereinto. Likewise, by molding the bumper separately from the bolt, no flashing results along the bolt threads. A sharp demarcation between the bolt and the material of the bumper is thus obtained which is aesthetically pleasing and which renders the full axial length of the bolt exteriorly of the bumper available for axial adjustment with respect to the swinging clamping arm that carries the bolt.

Also by virtue of the toughness of the polyurethane material, not only is a chemical bond between the bumper and bolt rendered unnecessary, but a simple effective mechanical connection or interlock between the bumper and bolt is made readily feasible, whereby the bumper may be simply and economically assembled with the bolt and removably secured thereto.

The interlock may merely comprise a small radial enlargement in the bolt receiving socket and a mating radial enlargement swaged on the bolt, or may simply comprise the bolt threads effecting an interference fit with the circumferential wall of the socket, whereby the resilient polyurethane material yields without rupturing or shearing to enable insertion of the bolt into the socket, and thereafter resiliently flows into the thread grooves of the bolt to effect the necessary interlock. A partial screw turn of the bolt may then be applied to force the latter tightly against the bottom or base of the socket and thereby resiliently stress the polyurethane material to enhance the interlock.

In a preferred construction, the interlock comprises a couple of screw thread turns molded into the socket adjacent its base to mate with the threads of the bolt. In contrast to the rubberlike or neoprene material employed heretofore, the tough polyurethane material of the bumper will effect the necessary interlock if its threaded portions extend axially only a few helical turns from the base of the socket. The remaining major axial portion of the socket periphery or sidewall may be smooth and unthreaded and dimensioned to receive the threaded bolt snugly and slidably therein with a slight interference fit. Accordingly the bolt, which may comprise a steel shank threaded throughout its axial length, may be forced coaxially without rotary motion into the open end of the socket and substantially to the base of the latter before encountering the threaded portion of the socket. A couple of turns of the bolt within the socket will then screw the bolt to its assembled position with its end seated firmly against the base of the socket and with the polyurethane threads of the bumper resiliently stressed to effect the desired interlock.

Where it is convenient to assemble the bolt and bumper at the molding site for the bumper, the bolt may be pushed axially into the bumper socket entirely to the bolt abutting base without any screw action if done shortly after the bumper is removed from the mold, for example within about thirty minutes. During that time the polyurethane will not be completely cured and its threaded portion within the socket will yield to enable the insertion of the bolt by axial movement only, thus further simplifying the assembly. As described above, the bolt will be given a final partial screw turn to screw it firmly against the socket base and enhance the interlock.

Usually one and one-half or two turns of the screw threads molded within the socket are adequate to secure the bolt and bumper together and to withstand the shearing forces of a clamping operation. The slight interference fit between the unthreaded socket sidewall and threaded bolt will cause the unthreaded sidewall to flow into the thread grooves of the bolt. The toughness of the polyurethane will resist cutting or permanent deformation by the bolt threads.

In accordance with the structure described herein, if a molded bumper is defective, it may be recycled before being assembled on the bolt. If a defect in either the bolt or the bumper is noted after the assembly, the bumper can readily be unscrewed from the bolt and recycled. The saving in material will partially offset its cost. Additional savings can also be made in shipping costs when the molding site for the bumpers is remote from where the bolts are manufactured. There is no need to ship the comparatively heavy bolts to the molding site, then ship the assembled bolts and bumpers for assembly with the remainder of the clamping assembly. Instead, the lightweight bumpers can be shipped directly from the molding site to the final assembly.

Prior art known to applicant that should be made of record in this application are U.S. patents to:

Brown—U.S. Pat. No. 2,519,107—Aug. 15, 1950
Higgins—U.S. Pat. No. 2,930,409—Mar. 29, 1960
Kennedy—U.S. Pat. No. 2,379,529—July 3, 1945
Ferguson—U.S. Pat. No. 2,551,834—May 8, 1951
Wilson—U.S. Pat. No. 2,705,336—Apr. 5, 1955

Brown shows a clamping device comprising a threaded bolt 15 and cushioning element of neoprene or rubber-like material secured to an enlarged head 14, which the present invention specifically avoids. Also the cushion 18 of Brown is not subject to a radial clamping force and provides no means for withstanding such a radial force, as for example a supporting socket comparable to applicant's for confining the threaded bolt shank coaxially therein with an interference fit throughout an appreciable axial extent.

The last four patents are typical of protective caps for various purposes. None suggests taking advantage of the properties of a molded polyurethane material in combination with a specific structure comprising a bolt removably secured within the socket of a polyurethane bumper and resiliently gripped by an interference fit with the socket wall throughout an axial extent greater than the bolt diameter, such that without recourse to chemical bonding between the bolt and bumper or an enlarged force distributing bolt head, the bumper readily withstands the unavoidable axial and radial clamping forces without being crushed or sheared by the bolt and also effects a highly resilient contact with the clamped workpiece, whereby the bumper is readily and economically replacable when worn, the bolt may be readily coated with any desired metallic plating by the most effective process available, and the above noted advantages and economies resulting from molding the bumper separately from the bolt are obtained.

Other objects of this invention will appear in the following description and appended claims, reference being had to the accompanying drawings forming a part of this specification wherein like reference characters designate corresponding parts in the several views.

It is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
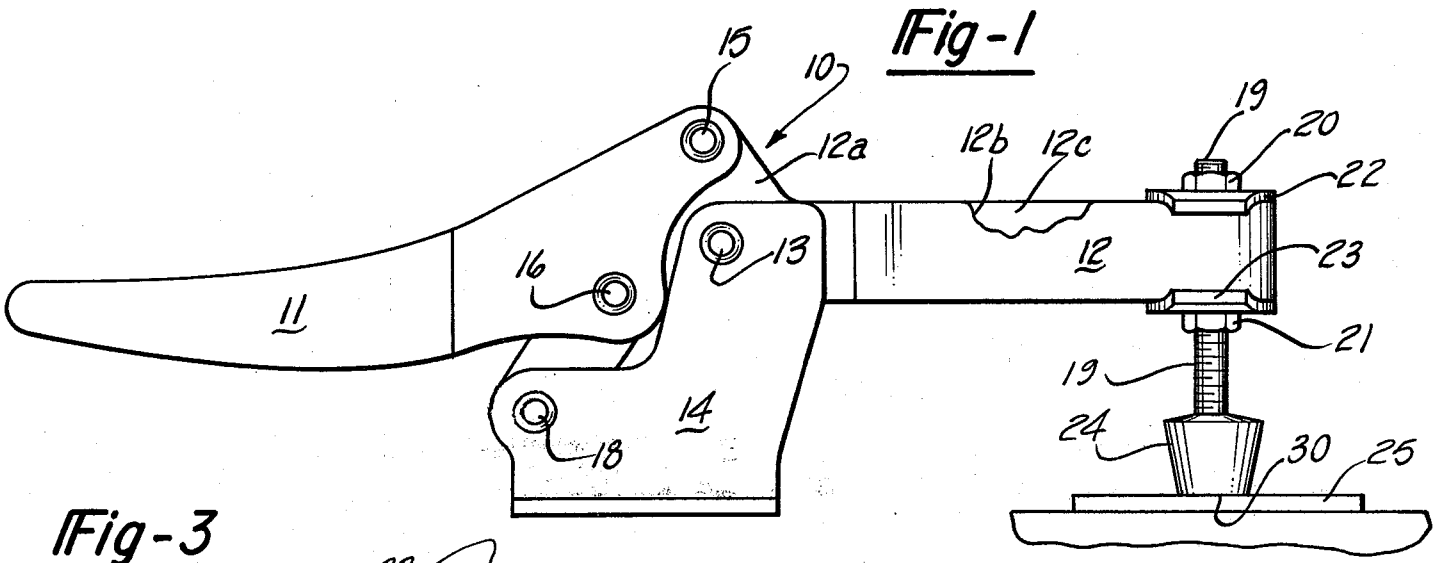
FIG. 1 is a side elevational view of a toggle clamp embodying the present invention.

Referring to the drawings, a conventional toggle clamp 10 is illustrated comprising a lever or manually operated handle 11, which may also be power operated, and a clamping or operating lever 12. The latter is pivotally secured at 13 to a fixed support 14 and has a short dogleg extension 12*a* extending obliquely rearwardly in FIG. 1 to an upper pivotal connection 15 with a forward end of the lever 11. Somewhat below the pivot 15, the lever 11 is pivotally connected at 16 to the upper end of a link 17. The lower end of link 17 is pivotally connected at 18 to the support 14.

Forwardly of the pivot 13, the lever 12 comprises two parallel arms 12*b* and 12*c* spaced apart sufficiently to provide an adjustment slot for receiving a threaded plunger or toggle bolt 19 therebetween at any adjusted position along the length of the arm 12. The bolt 19 may comprise a screw threaded steel shaft or stud of circular cross section, copper plated and having upper and lower clamping nuts 20 and 21 screwed thereon and spaced from the upper and lower edges of the arms 12*b, c* by clamping brackets 22 and 23 respectively. The lower end of the plunger 19 is removably secured as described below to a work engaging bumper 24 of elastic cushioning material, such as a molded polyurethane.

It is apparent from the structure described and illustrated that the bolt or plunger 19 may be adjustably secured to the lever 12 by the nuts 20, 21 at any location along the length of the slot between the arm 12*b, c*. Upon upward or clockwise movement of the rear handle end of lever 11, the link 17 will swing counterclockwise about its lower pivot 18 and the pivot 15 will move counterclockwise about the pivot 13 to swing the lever 12 counterclockwise and raise the work engaging bumper 24. Upon downward movement of the handle of lever 11, the reverse operation will take place and the bumper 24 will be forced downwardly by the toggle action, as for example to clamp a workpiece 25 against a fixed support or bench 26. Thus far the toggle clamp may be conventional and is not described in further detail.

The bumper 24 comprises an injection molded polyurethane body 27 having an axially extending and upwardly opening bolt receiving socket 28 therein. The base 29 of the socket 28 comprises a bolt supporting or abutting surface spaced axially from a lower work engaging and cushioning surface 30.

The upper major portion of the socket 28 remote from the base 29 comprises a smooth, unthreaded bore of circular section dimensioned to receive the threaded bolt 19 slidably coaxially therein with a slight interference fit. The lower portion of the socket 28 is provided with not more than approximately three helical turns 28*a*, and preferably one or two turns of a screw thread dimensioned to mate with the threads of the bolt 19. The bumper 24 is assembled on the lower end of the bolt 19 by forcing the latter coaxially into the open upper end of the socket 28. The polyurethane body 27 is sufficiently elastic to yield and enable the axial insertion of the bolt 19 until its lower end engages the axial upper end of the threaded portion 28*a*. Thereafter the bumper 24 and bolt 19 are rotated with respect to each other and pressed axially toward each other in a screw action, whereby the bumper 24 is screwed onto the lower end of the bolt 19 until the latter firmly abuts the socket base 29.

The toughness of the polyurethane material and its resistance to shearing enables the axial sliding movement of the bolt 19 into the smooth unthreaded portion of the socket 28 without cutting or permanently deforming the material of the bumper 24. The latter will in fact yield radially upon the axial insertion of the bolt 19 and will thereafter, by virtue of its resiliency and the interference fit between the circumferential wall of the socket 28 and the outer diameter of the bolt threads, flow partially into the latter threads. Only a couple of turns of the threads 28*a* are adequate to withstand the shearing forces thereon resulting from the clamping operation. After the lower end of the bolt 19 abuts the base 29, the application of additional screw force for a partial turn of the bumper 24 will stress and resiliently deform the threads 28*a* and base 29 to effect a frictional interlock with the bolt 19.

The thickness of the sidewalls of the socket 28 and of the cushioning body 27 below the socket base 29 are on the order of magnitude of the radius of the bolt 19, which in turn is determined by the maximum clamping force to be exerted by the clamp 10. The axial extent of the socket 28 is preferably greater than the diameter of the bolt 19 and usually about three or more times the radius of the bolt 19 to provide adequate support for withstanding lateral or radial shearing force exerted by the bolt 19 against the bumper 24 in consequence of the arcuate clamping movement about the pivot 13 when the bumper surface 30 engages the workpiece 25. No enlarged bolt head or other large area force distributing surface is required to be inserted or molded into the bumper 24, nor is any chemical bond with the bolt 19 required to enable the assembly to withstand the clamping forces.

The polyurethane material of the bumper 24 enables the dimensions and serviceability noted above and at the same time achieves a cushioning effect for protecting the clamped workpiece 25 that cannot be achieved with rubberlike or neoprene materials without recourse to the aforesaid chemical bonding and bolthead type interlock and force distribution. The cushioning effect of the bumper 24 is determined by the axial thickness between the surfaces 29 and 30 and may be adequate to yield and distribute the clamping force over a rough or uneven workpiece surface, rather than to concentrate the force at the high spots of the workpiece. Furthermore the polyurethane bumper described achieves superior durability compared to conventional neoprene. Whereas conventional neoprene bumpers begin to disentegrate under test conditions after fifty thousand clamping cycles, the polyurethane bumpers merely exhibit expectable wear, but no sign of deterioration.

Figure 2:
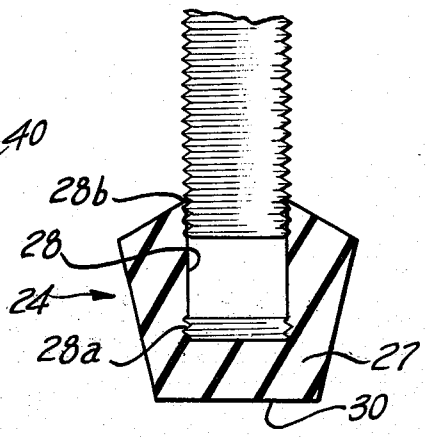
FIG. 2 is an enlarged sectional view taken along the axis of the toggle bolt and elastomeric bumper illustrated in FIG. 1, showing the bolt in position for assembly within the socket of the bumper.
Figure 3:
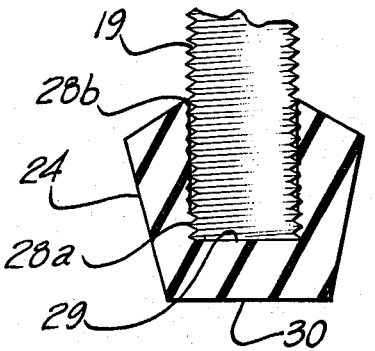
FIG. 3 is a view similar to FIG. 2, showing the bolt and bumper assembled together.

The interference fit between the outer surfaces of the bolt threads and the smooth bore portion of the socket 28 is preferably about three to five thousandths of an inch in the preferred form illustrated in FIGS. 2 and 3. The threads 28*a* supplement the frictional interlock with the bolt 19 when the bumper 24 is screwed on tightly. The threads 28*a* positively resist all normally encountered axial forces tending to displace the bolt axially from the bumper 24. Although it is characteristic of polyurethane to yield readily and enable limited deformation to effect the desired protective cushioning for the workpiece 25, the resistance of the polyurethane to additional deformation increases tremendously. Thus the axial extent of the socket 28 noted herein adequately replaces the customary chemical bond between the bolt and bumper required heretofore.

By molding the bumper 24 separately from the bolt 19, the upper edge 28*b* around the socket 28 provides a sharp demarcation with the bolt 19. That is, no portion of the bumper 24, such as flashing, extends above the edge 28*b*. The entire axial length of the bolt 19 is thus available for axial adjustment between the workengaging surface 30 and the workpiece 25. In fact the adjustment nut 21 may be screwed along the threaded bolt 19 until it engages the edge 28*b* and may thereafter be screwed one or two more turns downwardly by reason of the resiliency of the polyurethane.

The bumper 24 is formed by conventional injection molding technique. If the bolt 19 is manufactured adjacent the molding site, the cross-linking nature of the polyurethane enables the bolt to be inserted axially into the socket 28 without any screw action during the first half hour or so after the bumper 24 is removed from the molding die. During this time period, the polyurethane will not be cured sufficiently to offer appreciable resistance to resilient deformation of the threads 28*a*. Thus the bolt 19 may be thrust axially into the socket 28 and into abutment with the base 29 without screw action. The threads 28*a* will yield resiliently without permanent deformation to enable axial passage of the bolt 19. The latter may then be turned in a screw action until the threads 28*a* mate with the bolt threads. This latter screw action will not exceed a full rotation. Thereafter the bolt 19 may be turned an additional portion of a rotation to stress the threads 28*a* and effect a positive frictional interlock with the bolt 19 when curing or hardening of the polyurethane is completed.

Figure 4:
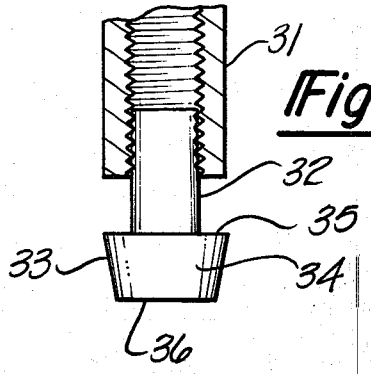
FIGS. 4 and 5 are views similar to FIG. 2, showing modifications.

If desired, the interference fit between the bolt 19 and bumper 24 may be effected without reliance on the socket threads 28*a*. As illustrated in FIG. 4, in lieu of the externally threaded bolt 19, an internally threaded tubular plunger 31 may be suitable secured in adjusted position to lever 12. A smooth unthreaded cylindrical support 32 of a polyurethane bumper 33 extends coaxially from an integral cushioning body 34 into the threaded interior of the plunger 31. The body 34 provides an upper annular shoulder 35 underlying the plunger 31 to abut and support the latter when the plunger 31 and bumper 33 are assembled. The under surface 36 comprises a workengaging cushioning surface comparable to the surface 30.

The interference between support 32 and the threaded interior of plunger 31 may be twice that described in regard to FIGS. 2 and 3. In other respects the functions of the parts shown in FIG. 4 are similar to the corresponding parts in FIGS. 2 and 3. The area of the annular shoulder 35 will be comparable to the area of the socket base 29 where comparable clamping forces are anticipated.

Assembly of the plunger 31 and bumper 33 is accomplished by forcing the support 32 axially into the threaded interior of plunger 31 without screw action until the lower annular end of plunger 31 seats against shoulder 35. If convenient, the assembly may be performed shortly after the bumper 33 is removed from its injection molding die and while the polyurethane is still in its highly flexible, partially cured condition. On the other hand, the aforesaid assembly operation and abutment of the plunger 31 and shoulder 35 may be completed at any time after the polyurethane is cured. In any event, the polyurethane of support 32 will yield resiliently and without shearing or permanent deformation to enable axial passage of the plunger 31. Thereafter the polyurethane will flow partially into the thread grooves of plunger 31. The bumper 33 may then be given a partial turn to force the lower end of plunge 31 snugly against the shoulder 35 by screw action, thereby to stress the latter and effect a frictional interlock between the plunger 31 and bumper 33.

Figure 5:
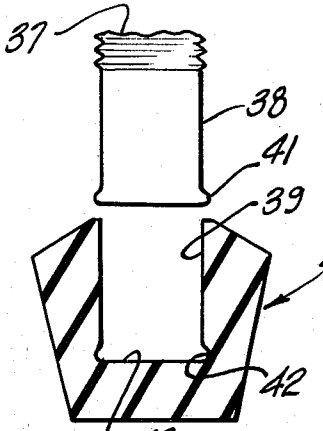

As illustrated in FIG. 5, the lower portion of a threaded plunger 37 may comprise a smooth unthreaded cylindrical surface 38 adapted to be inserted axially into the unthreaded socket 39 of a bumper 40 comparable to the bumper 24. The cylindrical surface 38 may be dimensioned to effect a slight interference or snug fit within socket 39, similar to the snug fit and for the same purpose described above in regard to plunger 19 within socket 28. A small annular enlargement 41 is swaged or otherwise formed at the lower end of plunger 37 and a mating annular enlargement 42 is provided in the socket 39 adjacent its base 43.

The bumper 40 is molded from polyurethane as described above, separately from the plunger 37 which is assembled by forcing its lower end into the socket 39 and into abutment with the base 41, either while the polyurethane is incompletely cured or subsequently as described above. The polyurethane material will yield resiliently and without permanent deformation to enable axial passage of the enlargement 41 until it snaps into the enlargement 42. The peripheral portions of the socket 39 will then closely engage the plunger surface 38 in supported relationship as above described. Although the enlargements 42 and 42 need not be at the base portions of the plunger 37 and socket 39 respectively, such locations are preferred to effect an optimum interlock between enlargements 41 and 42 of comparatively small radial dimensions. Thus the axial assembly of the plunger 37 into socket 39 is facilitated. Also preferably the enlargement 41 is rounded in cross section, so the lower leading edge of the rounded enlargement 41 serves as a cam during the assembly operation.

Various polyurethane formulations known to the art may be used in the bumpers described above in order to obtain the desired properties including hardness, elasticity, tensile strength and resistance to tearing required to withstand the expected clamping forces and also to afford the type and extent of protection required for the workpiece engaged by the bumper. A typical polyurethane bumper now being used successfully has a hardness of approximately 36±3, Shore D durometer, measured by The American Society for Testing Materials (ASTM) procedure D2240, which approximates a durometer of 87 Shore A and is considerably harder than neoprene bumpers, which for comparable clamping operations are limited to about 70 Shore A durometer.

The much softer neoprene is required because the formulation and clay additives necessary to increase its hardness also rapidly decrease its resiliency and elasticity. In consequence, a compromise between the desired hardness, resiliency, and elasticity must be made at the sacrifice of an optimum bumper and, as explained above, the softer neoprene bumper must be bonded to the toggle bolt to prevent rapid disintegration of the assembly.

Polyurethane in the above noted durometer range may have an ultimate tensile strength of approximately 5000 psi by ASTM Test Method D412, as compared to approximately 1500 psi for the above described neoprene, is capable of appreciably greater elongation within its elastic limits than the neoprene, and further in comparison to the neoprene, readily stretches initially from an unstressed condition but rapidly increases its resistance to elongation as it approaches its elastic limit; e.g., elongates approximately 100% at 675 psi, 200% at 950 psi, 300% at 1450 psi, and 400% at the ultimate 5000 psi. In addition, the polyurethane tear strength of 425 pli (ASTM Test Method D635-Die C) is in the neighborhood of twice that for the aforesaid neoprene.

I claim:

1. In combination, an axially extending screw threaded plunger, an elastomeric work engaging bumper having a body axially spacing a work engaging surface and an abutment surface, the bumper and one end of the plunger having coaxial telescoping portions removably secured together in closely interfitting relationship one within the other, said one end of the plunger abutting said abutment surface of the bumper, the interior telescoping portion extending coaxially into a mating axially opening socket in the exterior telescoping portion and having a cross-section slightly greater than the cross-section of said socket to effect an interference fit therein stressing the elastomeric material of said bumper, and means in addition to said interference fit yieldably resisting relative axial displacement between said telescoping portions comprising a screw threaded portion of said bumper extending axially from said abutment surface for a minor part of the axial extent of said telescoping portions, the remaining major axial extent of the telescoping portion of said bumper comprising in its unstressed condition prior to assembly with the plunger a smooth unthreaded surface for effecting an interference fit with the telescoping portion of said plunger, the elastomeric material of said unthreaded bumper surface stressed by said interference fit projecting resiliently within its elastic limit into the screw threads of said plunger.

2. The combination according to claim 1, the elastomeric material of said bumper having the physical properties of a polyurethane capable of yielding resiliently without rupturing its threaded portion to enable relative axial and nonrotatable movement of said telescoping portions into said closely interfitting relationship until said plunger abuts said abutment surface.

3. The combination according to claim 2, said material of said bumper comprising a polyurethane having a durometer of approximately 37 D, a tear strength of approximately 425 pli and an elongation of 100% and 400% at approximately 675 psi and 5000 psi respectively.

4. The combination according to claim 2, said plunger comprising an axially extending screw threaded bolt, said bumper having said axially extending socket containing the telescoping portion of said bolt, the base of said socket comprising said abutment surface, and the axially extending wall of said socket comprising said exterior telescoping portion, the radial thickness of said wall and the radius of said bolt being approximately of the same order of magnitude.

5. The combination according to claim 4, the axial spacing between said work engaging surface and abutment surface and the radius of said bolt being approximately of the same order of magnitude, and the axial extent of said telescoping portions being greater than the diameter of said bolt.

6. The combination according to claim 4, the interior surface of the wall of said socket adjacent to said abutment surface being threaded to mate with the screw threads of said bolt, the threads of the latter being in screw threaded engagement with the threaded portion of the wall of said socket, the major axial extent of the interior surface of the wall of said socket comprising in its unstressed condition a smooth unthreaded cylindrical surface effecting said interference fit with the threaded bolt.

7. A work clamping assembly having a pivotal plunger operating means, an axially extending screw threaded plunger, screw threaded means cooperable with the threads of said plunger for securing the latter at selected axially adjusted positions to said operating means for pivotal clamping movement in a direction substantially axially of said plunger, and an elastomeric work engaging bumper of molded polyurethane material having a body axially spacing a work engaging surface and an abutment surface, the abutment surface abutting one end of said plunger, said bumper also having a screw threaded portion mating coaxially with a threaded end portion of said plunger at said one end and removably secured thereto in screw threaded relationship, said threaded portion and end portion comprising telescoping portions closely interfitting one within the other, the screw threads of said bumper extending axially from said abutment surface for a minor part of the axial extent of said telescoping portions, the remaining major axial extent of said telescoping portion of said bumper comprising in its unstressed condition a smooth unthreaded surface effecting an axially sliding interference fit with the telescoping portion of said plunger, the elastomeric material of said unthreaded bumper surface stressed by said interference fit projecting resiliently within its elastic limit into the screw threads of said plunger.

8. The combination according to claim 7, the screw threads of said bumper comprising approximately two helical turns extending axially from said abutment surface.

9. The combination according to claim 8, said plunger comprising an externally threaded bolt of circular cross section transverse to its axis, said bumper having an axially extending socket in the body thereof and having said bolt therein, the base of said socket comprising said abutment surface.

10. The combination according to claim 9, the axial extent of said socket being of the order of magnitude of approximately three times the radius of said bolt, the radial thickness of the wall of said socket and the axial spacing between said work engaging surface and abutment surface being approximately of the order of magnitude of the radius of said bolt.

* * * * *